US005836382A

United States Patent [19]

Dingle et al.

[11] Patent Number: 5,836,382

[45] Date of Patent: Nov. 17, 1998

[54] EVAPORATOR REFRIGERANT DISTRIBUTOR

[75] Inventors: Steve S. Dingle; Jon P. Hartfield, both of La Crosse, Wis.

[73] Assignee: American Standard Inc., Piscataway, N.J.

[21] Appl. No.: 978,782

[22] Filed: Nov. 26, 1997

Related U.S. Application Data

[63] Continuation of Ser. No. 684,611, Jul. 19, 1996, abandoned.

[51] Int. Cl.[6] ..... F28D 7/00

[52] U.S. Cl. ..... 165/160; 165/DIG. 402

[58] Field of Search ..... 165/159, 160, 165/DIG. 402; 137/561 A

[56] References Cited

U.S. PATENT DOCUMENTS

| | | | |
|---|---|---|---|
| 456,923 | 7/1891 | Barnstead | 165/160 |
| 3,125,161 | 3/1964 | Romanos | 165/159 |
| 3,267,693 | 8/1966 | Richardson et al. | 165/160 X |
| 3,326,280 | 6/1967 | Bosquain et al. . | |
| 4,415,024 | 11/1983 | Baker . | |
| 4,539,940 | 9/1985 | Young . | |
| 4,576,222 | 3/1986 | Granata, Jr. et al. . | |
| 5,203,405 | 4/1993 | Gentry et al. . | |

FOREIGN PATENT DOCUMENTS

| | | | |
|---|---|---|---|
| 61-175492 | 8/1986 | Japan | 165/159 |
| 714911 | 9/1954 | United Kingdom | 165/159 |
| 722775 | 1/1955 | United Kingdom . | |

OTHER PUBLICATIONS

Drawing 4534–4930, The Trane Company, Feb. 16, 1993.
Drawing 4518–6632, The Trane Company, Jan. 6, 1976.
Drawing 4518–9473, The Trane Company, Jun. 7, 1976.
"York Applied Systems", pp. 4 and 20, 1994.
19XL 50/60 Hz Hermetic Liquid Chiller, p. 5, 1992.

*Primary Examiner*—Leonard R. Leo
*Attorney, Agent, or Firm*—William J. Beres; William O'Dirscoll; Peter D. Ferguson

[57] ABSTRACT

A refrigerant distributor for use in a shell and tube evaporator has a decreasing cross-sectional area which uniformly distributes refrigerant to the tube bundle within the evaporator shell and operates with a small distributor to evaporator pressure drop.

10 Claims, 7 Drawing Sheets

EVAPORATOR REFRIGERANT DISTRIBUTOR

This application is a continuation of U.S. parent application Ser. No. 08/684,611, filed Jul. 19, 1996, now abandoned.

BACKGROUND OF THE INVENTION

The present invention relates to shell and tube heat exchangers and, more particularly, to a refrigerant distributor for use in the evaporator of a liquid chiller or similar apparatus.

Shell and tube heat exchangers have long been used in liquid chillers and have been developed to a significant degree of sophistication. These heat exchangers comprise a shell in which a tube bundle is disposed.

Certain shell and tube heat exchangers have been adapted for use as evaporators in chiller systems. Such evaporators, through the use of a heat transfer medium, transfer heat from a heat load, which requires cooling, to a refrigerant. The refrigerant ultimately rejects the heat it receives in the evaporator to a heat sink. One type of shell and tube evaporator is a so-called flooded evaporator in which a tube bundle, through which a heat transfer medium flows, is substantially immersed in liquid refrigerant.

As shown in FIG. 1, for example, piping 97 of heat transfer circuit 22, through which a heat transfer fluid such as water flows, includes heat transfer tubes 20 which are disposed interior of shell 24 of evaporator 28. Tubes 20 are thus in flow communication with a space or other heat load 26 which requires cooling.

At the same time, a refrigerant, such as those referred to in the industry as R-11, R-12, R-123 or R-134*a*, among others, flows through chiller refrigerant circuit 30. Circuit 30 includes the interior of evaporator shell 24 in which tubes 20 are disposed.

In operation, refrigerant flows out of evaporator 28 to compressor 32 then to and through condenser 34. The refrigerant then flows back into shell 24 of evaporator 28 to complete circuit 30. The purpose of condenser 34 is to place the refrigerant flowing through circuit 30 in heat exchange contact with a "heat sink" 36, such as air or water, to which heat in the refrigerant can be rejected. In a system sense, heat transfer circuit 22 cooperates with chiller refrigerant circuit 30 to transfer heat from the heat load 26 to the heat sink 36 so as to cool the heat load. The chiller is the "tool" by and through which such heat transfer is accomplished.

More particularly, the heat transfer fluid in circuit 22 is warmed and carries heat away from heat load 26 as the fluid passes in contact with heat transfer surfaces 27 which are in direct heat exchange contact with the heat load. The warmed transfer fluid then flows to and through tubes 20 in evaporator 28. Tubes 20 transfer heat from the transfer fluid to the relatively cooler refrigerant which surrounds tubes 20 within evaporator shell 24. This transfer of heat causes the refrigerant exterior of tubes 20 to evaporate and the transfer fluid interior thereof to be cooled. The now relatively cooler heat transfer fluid is returned to the heat load where it is re-used to transfer additional heat from the heat load.

The refrigerant vapor created by the heat transfer process that occurs in evaporator 28 flows out of evaporator shell 24, at a relatively low pressure, to compressor 32. As a result of the compression process which occurs in compressor 32, the refrigerant vapor becomes more dense and its temperature is elevated significantly. The refrigerant is discharged from the compressor and flows to and through condenser 34.

Condenser 34 acts to transfer heat from the relatively warm refrigerant vapor delivered to it from compressor 32 to a relatively cooler heat sink 36 such as ambient air, the earth or a water source. The transfer of heat from the refrigerant flowing through the condenser to the heat sink cools the refrigerant and causes it to condense to liquid form. The refrigerant then flows out of the condenser and to and through expansion device 38 which further lowers its temperature and pressure. The refrigerant then flows back into the shell 24 of evaporator 28 for re-use therein.

Some chillers include an economizer 40. If an economizer is employed it will be disposed upstream of expansion device 38 but downstream of a second or additional expansion device 99. In such systems, additional expansion device 99 will typically be disposed in piping 98 which connects condenser outlet 42 to the economizer vessel while expansion device 38 will be disposed at the inlet 44 to evaporator 28. The economizer itself will have an inlet 46 connected for flow to expansion device 99, a liquid outlet 48 connected to expansion device 38 and a vapor outlet 52 connected to an intermediate pressure port 33 of compressor 32.

In chillers which include an economizer option, the flow of relatively high pressure and temperature liquid refrigerant from condenser 34 through expansion device 99 causes a first reduction of refrigerant temperature and pressure and the "flashing" of a portion of the refrigerant to gaseous form. The function of economizer 40 is to separate the liquid and gaseous portions of the refrigerant which are created by the flow of the refrigerant through expansion device 99.

The gaseous portion of such refrigerant, which will be at a pressure between compressor suction and discharge pressure, is delivered from economizer 40 to compressor 33 where its addition to the lower pressure gas undergoing compression therein increases the efficiency of the compression process and, therefore, that of the chiller system. The liquid portion of the refrigerant is delivered from economizer 40 to expansion device 38 where it is still further reduced in temperature and pressure prior to its delivery to the interior of evaporator 28 as a two-phase mixture.

With respect to the delivery of refrigerant to the interior of evaporator 28 and to the heat transfer surfaces located therein in the form of tubes 20, there is a need to distribute such refrigerant uniformly across and down the length of the evaporator tube bundle. As such, a refrigerant distributor 54 is typically disposed in the lower portion of an evaporator to receive and distribute refrigerant within the evaporator shell.

Historically, refrigerant distributors have been of constant cross-section and, while relatively simple to manufacture, have required extensive labor in their welding and fit-up to the interior of the evaporator shell. Further, previous distributors have typically operated based upon the existence of a relatively large pressure differential as between the interior of the distributor and the interior of the evaporator shell. Such relatively large pressure differentials have been necessary in order to prevent the maldistribution of refrigerant to the evaporator tube bundle in such distributors. The need for such relatively large pressure differentials to achieve some semblance of uniform refrigerant distribution has, however, detracted from the efficient flow and control of refrigerant as it circulates throughout the chiller refrigerant system.

In operation, as refrigerant flows through the length of a refrigerant distributor, a portion of the refrigerant mass is driven by pressure out of a series of orifices located along its length. In previous distributors, mass flow and velocity have often decreased or varied irregularly along a distributor's length, even in the face of a relatively large differential pressure between the interior of the distributor and the interior of the evaporator shell. That, in turn, has resulted in pressure variations within and along the length of such distributors. Such variations in internal distributor pressures along the length of previous distributors often resulted in unequal amounts of refrigerant mass being expressed into the interior of the evaporator shell through different ones of the distributor orifices at any given time. The heat transfer process within the evaporators in which such distributors have been used has, therefore, not been as efficient as possible given the amount of refrigerant circulating in the chiller and the amount of heat transfer surface available for heat exchange within the evaporator shell.

Further, such variation and irregularity in refrigerant mass flow and velocity internal of a distributor, together with the existence of a relatively large pressure differential between the interior of previous distributors and the interior of the evaporator shells in which they have been installed, has often resulted in an inability to efficiently or effectively control refrigerant flow through the refrigerant circuit of the chiller.

Finally, many previous distributors have been required to be fabricated/built-up in place within the evaporator in which they are used. Such fabrication processes have been found to be expensive in terms of the labor and time involved therein.

The need therefore continues to exist to improve refrigerant distributors used in chiller evaporators in order to reduce their cost of manufacture and fit-up within an evaporator shell, to enhance the control of refrigerant flow therethrough and the distribution of refrigerant thereoutof and to increase the efficiency of the heat transfer process which occurs within such evaporators and within the chiller systems in which they are employed.

SUMMARY OF THE INVENTION

It is an object of the present invention to provide a refrigerant distributor for a shell and tube heat exchanger that is economical to manufacture and install.

It is another object of the present invention to reduce or essentially eliminate the pressure drop which occurs within refrigerant distributors used in evaporators of the shell and tube type.

It is still another object of the present invention to maintain essentially constant velocity in the refrigerant mass which flows through a refrigerant distributor within the evaporator of a liquid chiller.

It is a further object of the present invention to equalize and make more uniform the amount of refrigerant distributed along the length of a tube bundle in a shell and tube evaporator so as to (1) promote more efficient heat transfer therein, (2) increase the overall efficiency of the chiller system in which the evaporator is used and (3) achieve enhanced control of refrigerant flow within the evaporator and chiller system.

The present invention meets one or more of the above objects, in whole or in part, by providing a refrigerant distributor which defines a generally longitudinal flow passage having a predetermined, generally constant, decrease in its cross-sectional area in a direction away from its inlet. Orifices defined by the distributor are preferably equally spaced along the distributor flow passage so as to uniformly express refrigerant into the interior of the evaporator along the length of the tube bundle which is disposed therein. Uniform refrigerant distribution results from the maintenance of essentially constant pressure and velocity in the refrigerant mass as it flows through the distributor. Maintenance of essentially constant pressure and velocity in the refrigerant mass results from the configuration and geometry of the distributor itself.

DETAILED DESCRIPTION OF THE PREFERRED EMBODIMENT

Figure 1:
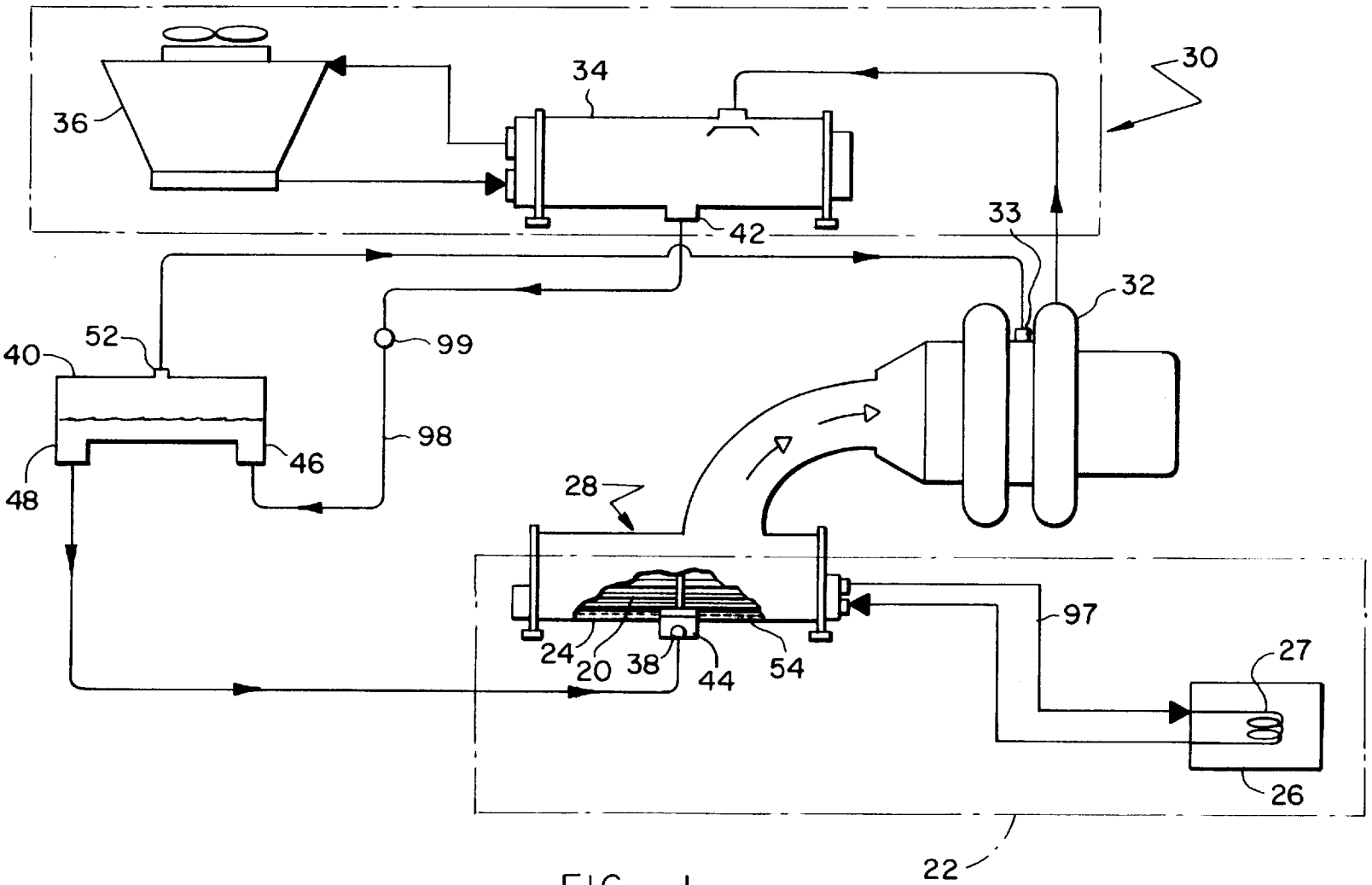
FIG. 1 is a flow diagram of a typical chiller system.
Figure 2:
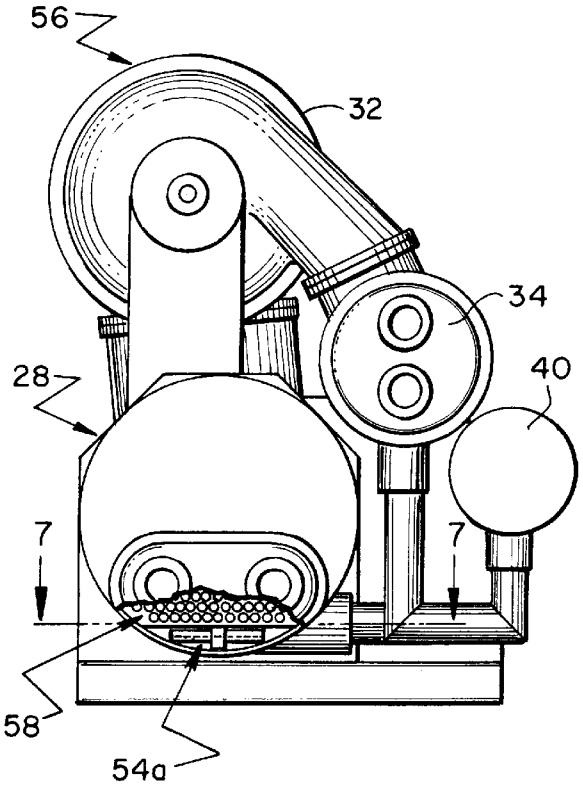
FIG. 2 is a side elevation of chiller such as the one employed in the chiller system of FIG. 1.
Figure 3:
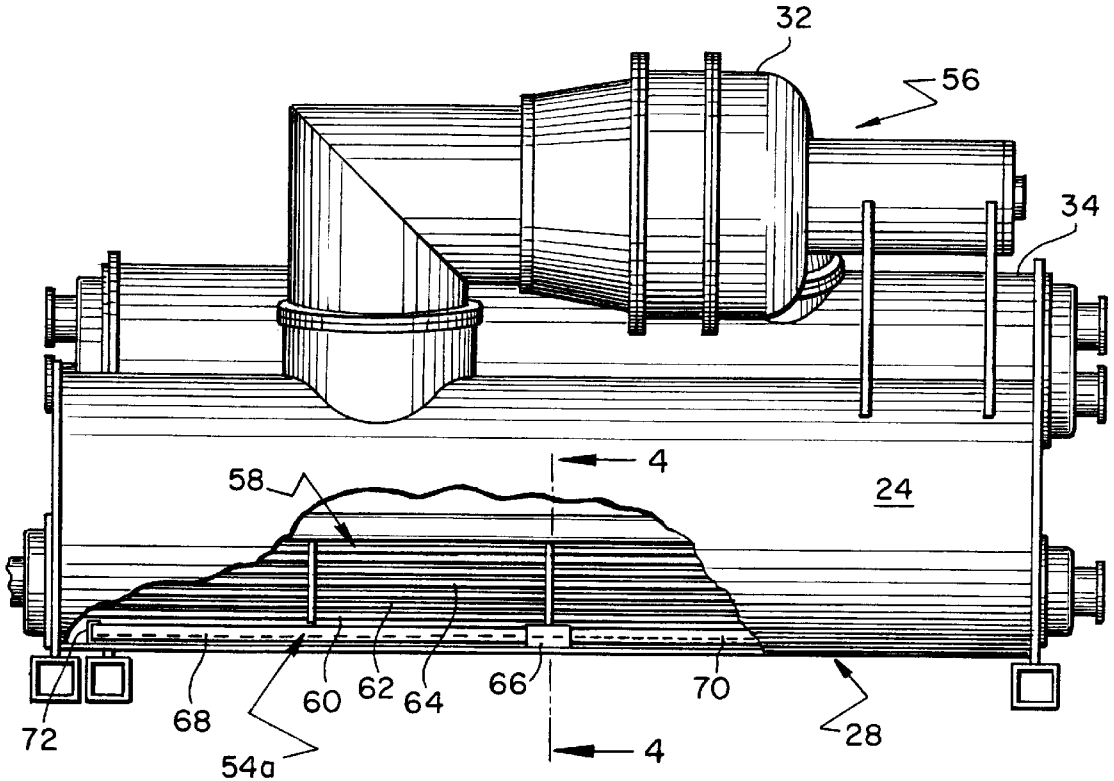
FIG. 3 is a front elevation of the chiller of FIG. 2 with a portion of the shell broken away to more clearly illustrate the evaporator tube bundle.

Referring now to the drawings, and in particular to FIGS. 2 and 3, chiller 56 includes an evaporator 28, a compressor 32, a condenser 34, and an economizer 40. As has been mentioned, the use of economizer 40 is optional.

Figure 4:
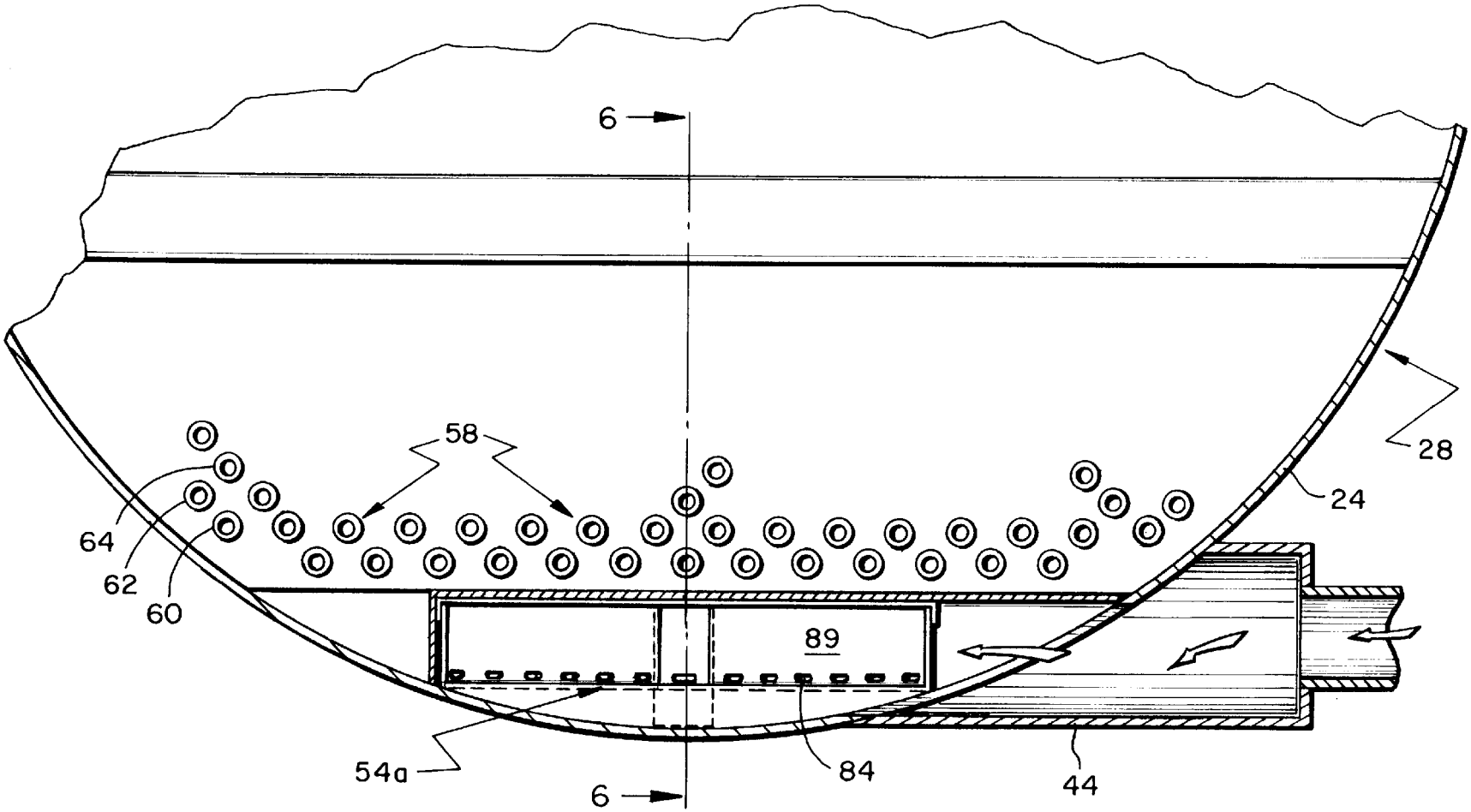
FIG. 4 is an enlarged section taken along line 4—4 of FIG. 3.
Figure 5:
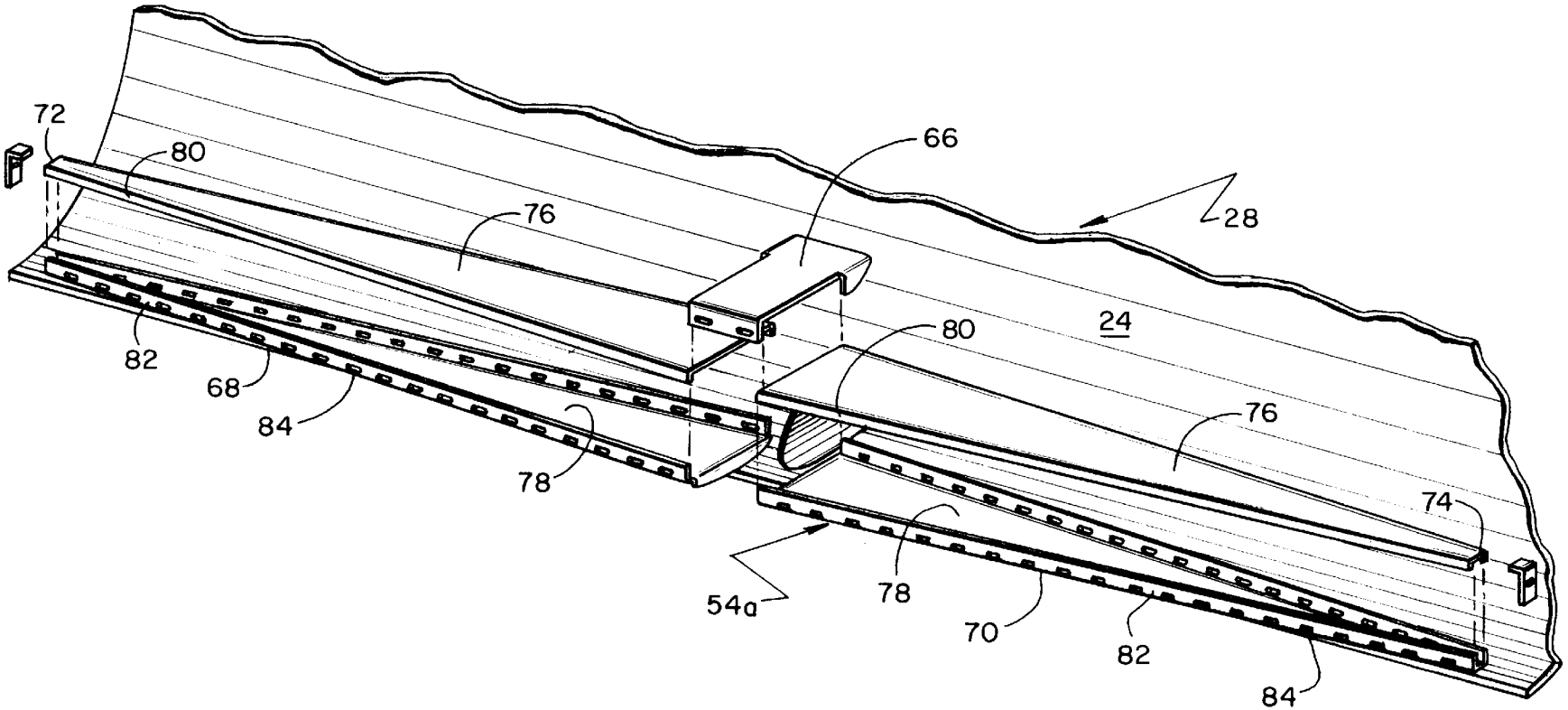
FIG. 5 is an exploded fragmentary perspective view of the refrigerant distributor as positioned in the evaporator of FIG. 3.
Figure 6:
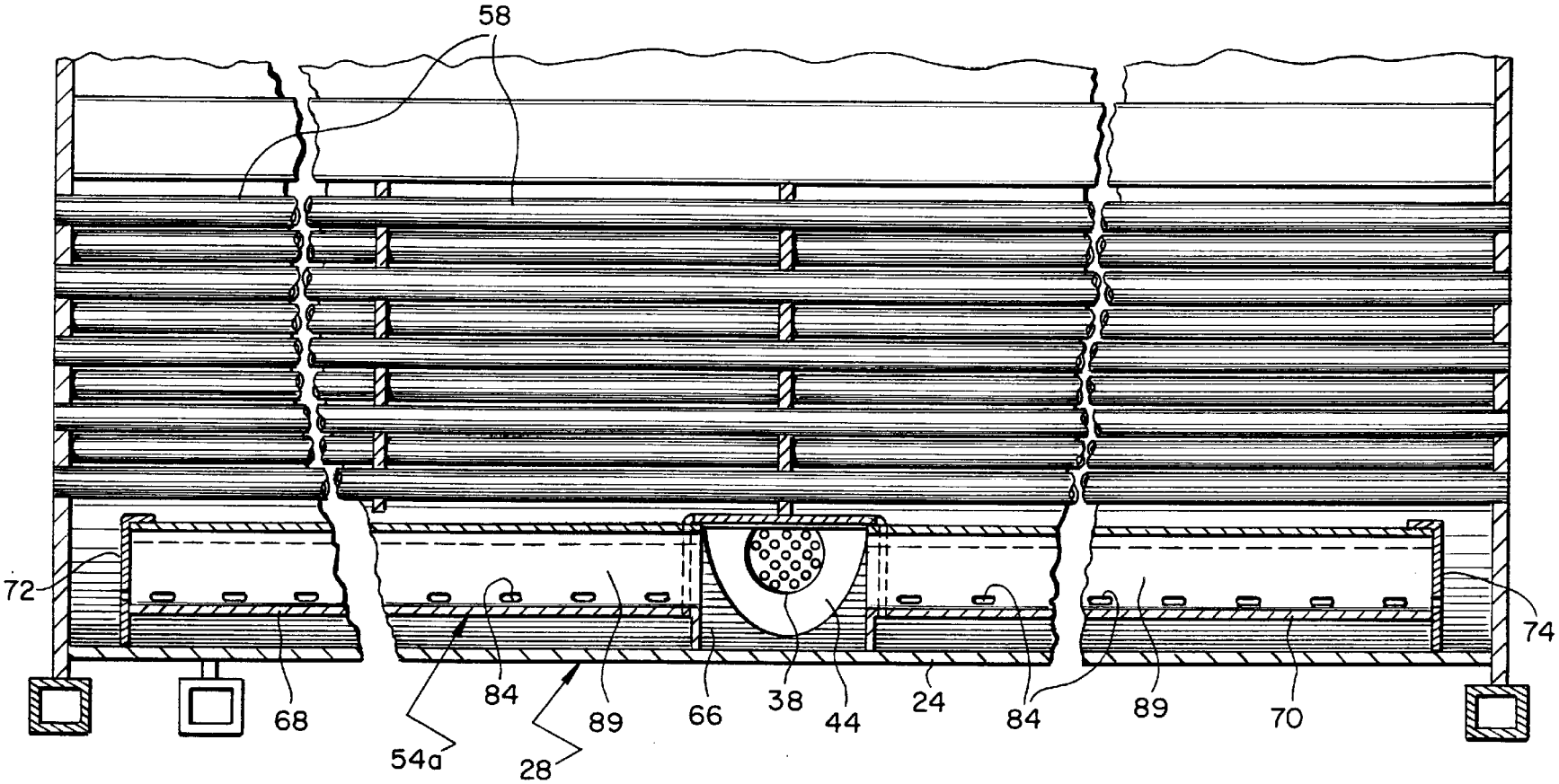
FIG. 6 is a view taken along line 6—6 of FIG. 4.

Referring additionally now to FIGS. 4, 5 and 6 it will be seen that evaporator 28 includes a shell 24 in which a tube bundle 58 and a refrigerant distributor 54*a* are disposed. Tube bundle 58 includes a plurality of tubes, such as tubes 60, 62, and 64, that extend longitudinally within the evaporator shell 24. Refrigerant distributor 54*a* is positioned in the lower portion of shell 24, generally below tube bundle 58, and like the tube bundle, extends longitudinally within and is essentially coextensive in length with the evaporator shell.

Refrigerant distributor 54*a* includes an inlet portion 66 and one or more branches 68, 70, each of which extend to respective distal ends 72, 74. In the preferred embodiment, two such branches are employed although a distributor having a single branch is contemplated and does fall within the scope of the present invention. The size/configuration of inlet portion 66 of distributor 54*a* will determine the maximum volumetric flow of refrigerant into and through distributor 54*a* and its branches and therefore, the volume of refrigerant which enters the evaporator shell.

Each distributor branch has a top or cover portion 76 and a bottom or trough portion 78 and, as such, is of two-piece construction. In the preferred embodiment, cover portion 76 includes a lip or skirt 80, which overlaps the sidewalls 82 of trough portion 78.

Likewise in the preferred embodiment, each one of the trough portions 78 of the two distributor branches 68 and 70 has generally equally spaced, equally sized orifices 84 along the longitudinal length of its sidewalls 82. The size and spacing of the respective orifices can be non-uniform or otherwise optimized to enhance the distribution of refrigerant along the length of shell 24 although orifices of equal size/spacing are preferred from the design, manufacturability and cost standpoint.

Two-piece distributor branches 68 and 70 will preferably be fabricated and assembled, such as by tack or spot welding, off-line and apart from the fabrication of the evaporator shell and its tube bundle. The branches, together with inlet 66, will subsequently be positioned and affixed within the shell. The ability to fabricate the distributor of the present invention off-line and to easily fit it up within the evaporator shell makes fabrication of both the distributor and evaporator significantly less time consuming, labor intensive and, therefore, less expensive.

The cross-sectional area of refrigerant flow passage 89 defined within each distributor branch preferably decreases at an essentially constant rate over the length of the branch. Accordingly, the largest cross-sectional area of each distributor branch 68, 70 exists at the end of the branch which is closest to inlet portion 66 and decreases as it runs to their respective distal ends 72 and 74.

Figure 7:
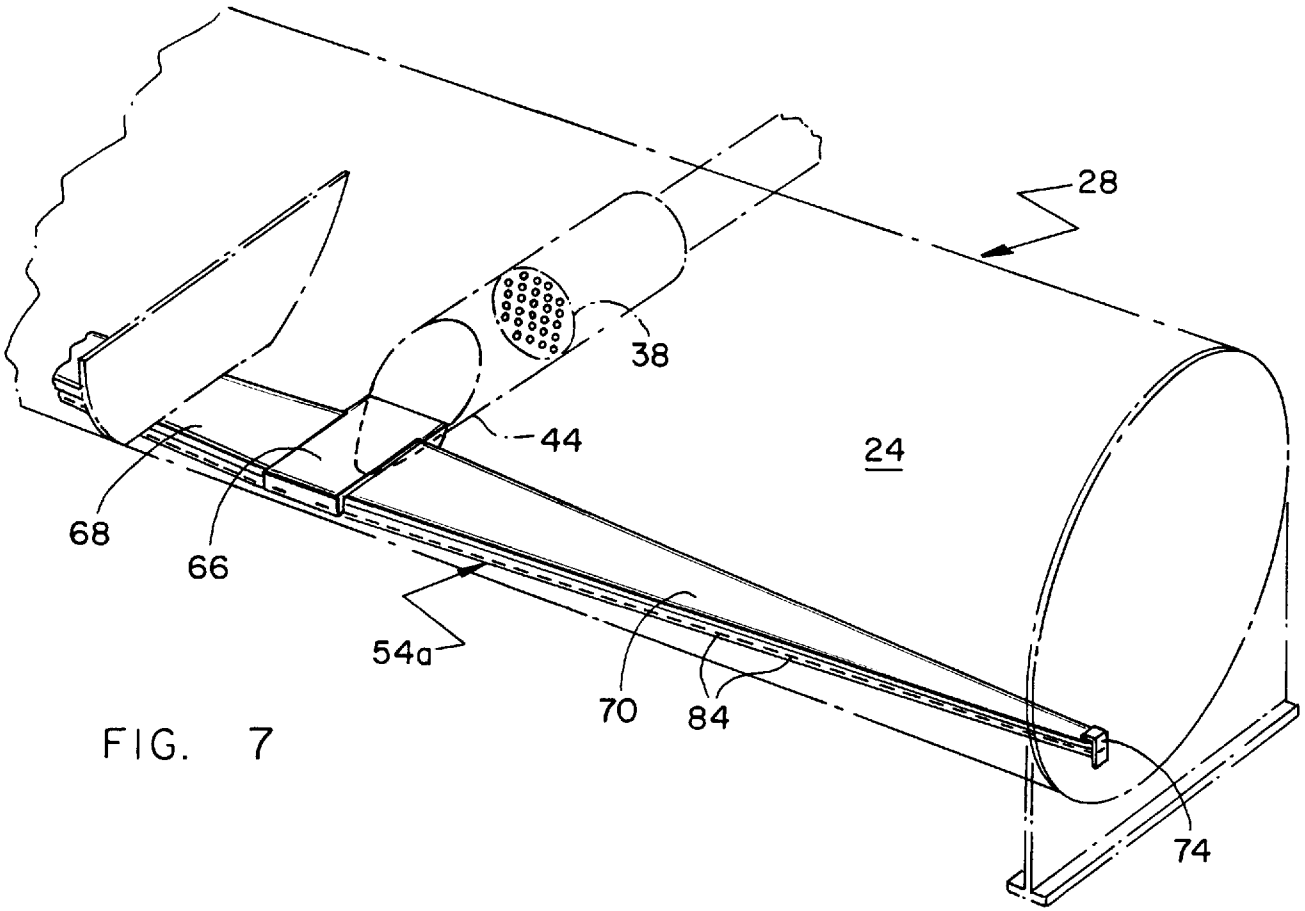
FIG. 7 is a perspective view, similar to FIG. 5, showing the positioning of the refrigerant distributor in an evaporator shell and its physical relationship to the piping through which refrigerant enters the evaporator shell.
Figure 8:
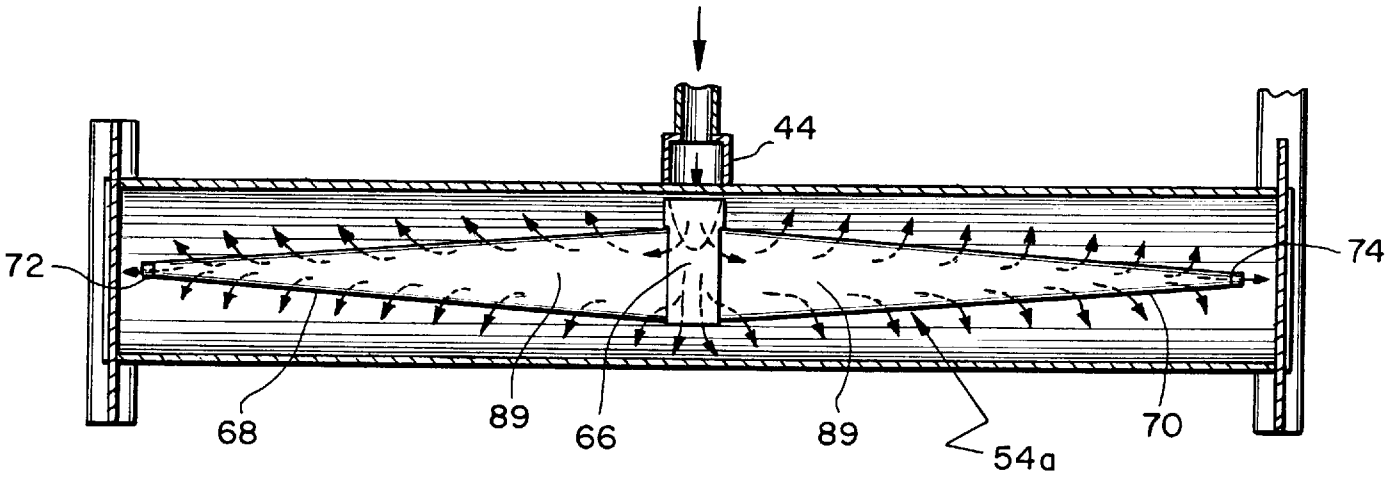
FIG. 8 is a view taken along the line 7—7 of FIG. 2.

Referring additionally now to FIGS. 7 and 8, inlet portion 66 of refrigerant distributor 54*a* is in fluid communication with expansion device 38 via evaporator inlet 44. In operation, two-phase, but primarily liquid refrigerant issues out of expansion device 38 and enters evaporator inlet 44 when chiller 56 is in operation. The refrigerant is communicated from the evaporator inlet 44 to inlet portion 66 of the refrigerant distributor. Inlet portion 66 of distributor 54*a* is configured to divide the flow of refrigerant evenly between distributor branches 68 and 70.

As has been noted, the cross-sectional area of passages 89 within distributor branches 68 and 70 decreases in a predetermined and generally constant fashion along their length in a direction from inlet portion 66 to their respective distal ends 72, 74. Such controlled reduction in cross-sectional flow area of the refrigerant passage maintains essentially constant pressure and velocity in the refrigerant mass as it flows through the distributor.

Maintenance of essentially constant pressure and velocity in the refrigerant mass flowing through the distributor, in turn, results in uniform refrigerant distribution through the distributor orifices into the interior and along the entire length of the evaporator. Because essentially constant pressure and velocity in the refrigerant is maintained by the distributor of the present invention, the distributor orifices can be sized to result in only a relatively small pressure differential (less than 2 p.s.i.) between the interior of refrigerant distributor 54*a* and the interior of shell 24 in order to achieve uniform refrigerant distribution.

The relatively small pressure differential needed to achieve such uniform results in the refrigerant distributor of the present invention, as compared to pressure differentials which were required to achieve adequate (if not uniform) refrigerant distribution by previous refrigerant distributors, permits significantly improved refrigerant flow control at the location of expansion device 38. This, in turn, allows expansion device 38 to be selected in a manner so as to optimize refrigerant metering and flow in an overall chiller system context.

Uniform refrigerant distribution within the evaporator results in more efficient use of the heat transfer surface of the evaporator tube bundle. The overall heat transfer efficiency within the evaporator and chiller system is therefore enhanced. Further, because of the nature of distributor 54*a* , including the two-piece construction of its branches economies in its fabrication and in the manufacture and assembly of evaporator 28 are realized which results in a significant cost savings in the manufacture of the chiller.

While the present invention has been described in terms of a preferred embodiment, it will be appreciated that changes may be made in the combination and arrangement of parts or elements as heretofore set forth without departing from the spirit and scope of the invention which is limited only by the language of the claims which follow.

What is claimed is:

1. A refrigerant evaporator for use in a liquid chiller comprising:

a shell, two-phase but primarily liquid refrigerant flowing into said shell when said chiller is in operation;

a plurality of tubes horizontally disposed in said shell and running generally longitudinally thereof; and a refrigerant distributor, said distributor being positioned generally below said tubes and having an inlet for receiving said two-phase but primarily liquid refrigerant into said shell, said distributor having a first and a second branch, each of said branches defining a refrigerant flow passage and being disposed above and spaced apart from the bottom of said shell, said inlet being disposed between said first and said second branches, the cross section of said flow passages generally decreasing in a direction away from said inlet, each of said branches being of two-piece construction, a first piece of said first branch and a first piece of said second branch each being a cover portion and a second piece of said first branch and a second piece of said second branch each being a trough portion, each of said branches defining a plurality of orifices communicating between a refrigerant branch flow passage and the interior of said shell, said orifices being generally equally spaced along each of said branches.

2. The evaporator according to claim 1 wherein said first and said second branches are disposed above and spaced apart from the bottom of said shell.

3. The evaporator according to claim 1 wherein said orifices are defined by and generally equally spaced along the trough portion of each of said branches.

4. The evaporator according to claim 1 wherein said orifices are generally uniformly sized, the size of said orifices being predetermined so as to result in a differential pressure between the interior of said distributor and the interior of said shell of less than two pounds per square inch when said chiller is in operation.

5. A refrigerant evaporator for use in a liquid chiller comprising:

a shell, two-phase but primarily liquid refrigerant flowing into said shell when said chiller is in operation;

a plurality of tubes horizontally disposed in said shell and running generally longitudinally thereof; and a refrigerant distributor, said distributor being positioned generally below said tubes and having an inlet for receiving said two-phase but primarily liquid refrigerant into said shell, said distributor having a first and a second branch, each of said branches defining a refrigerant flow passage and being disposed above and spaced apart from the bottom of said shell, said inlet being disposed between said first and said second branches, the cross-section of said flow passages generally decreasing in a direction away from said inlet, each of said branches being of two-piece construction, a first piece of said first branch and a first piece of said second branch each defining a plurality of orifices communicating between a refrigerant branch flow passage and the interior of said shell, the decrease in cross-sectional area of each of said passages defined by said branches in a direction away from said inlet being predetermined so as to maintain essentially constant pressure throughout said passage and so as to result in the expression of generally equal amounts of primarily liquid refrigerant out of each of said orifices along the length of said distributor and said plurality of tubes when said chiller is in operation, one piece of each of said two-pieces of which each of said branches is constructed being a cover portion and the second of said two-pieces being a trough portion, said cover portion and said trough portion cooperating to define a refrigerant flow passage having multiple sides, said orifices being defined in at least two of said multiple sides of said refrigerant flow passage.

6. The evaporator according to claim 5 wherein said orifices are uniformly sized, the size of said orifices being selected so as to result in the maintenance of a predetermined differential pressure between the interior of said distributor and the interior of said shell when said chiller is in operation.

7. The evaporator according to claim 6 wherein said orifices are defined by and are generally equally spaced along the trough portion of each of said first and said second branches and wherein said orifices are sized to maintain a differential pressure of less than two pounds per square inch between the interior of said distributor and the interior of said shell when said chiller is in operation.

8. A refrigerant distributor for use in a shell and tube heat exchanger comprising:

an inlet portion for receiving primarily liquid refrigerant into said heat exchanger; and a first and a second branch portion connected to said inlet portion, each of said first and said second branch portions (i) being disposed generally below the tubes of said heat exchanger but above and spaced apart from the bottom of said shell, (ii) defining a generally horizontal refrigerant flow passage in flow communication with said inlet portion, (iii) having a cross-sectional area which decreases in a direction away from said inlet portion, said decrease being at a generally constant rate in a direction away from said inlet, the rate of decrease in the cross-sectional area of said passages being predetermined so as to maintain essentially constant velocity and pressure in refrigerant flowing therethrough and (iv) being of two-piece construction, a first piece of said first branch portion and a first piece of said second branch portion defining a plurality of orifices along its length, said orifices being of generally uniform size, the refrigerant flow passages defined by each of said first and said second branch portions having at least two sides, said orifices being defined in at least two of said at least two sides so that refrigerant flows out of each of said distributor branch portions in at least two directions, said inlet portion receiving refrigerant flowing into said heat exchanger and dividing the flow of said refrigerant into generally equal portions, a first piece of each of said two-piece branch portions being a trough portion and the second piece of each of said two branch portions being a cover portion, said orifices being defined at generally equal intervals along the length of said trough portions.

9. The refrigerant distributor according to claim 8 wherein the refrigerant flow passages defined by each of said first and said second branch portions have at least two sides, said orifices being defined in at least two of said at least two sides so that refrigerant flows out of each of said distributor branch portions in at least two directions.

10. The refrigerant distributor according to claim 9 wherein said inlet portion receives refrigerant flowing into said heat exchanger and divides the flow of said refrigerant into generally equal portions, one of said equal portions being delivered to each of said at least two branches and wherein each of said at least two branches is comprised of a trough portion and a cover portion, said orifices being defined at generally equal intervals along the length of said trough portions.

* * * * *